US005920183A

United States Patent [19]

Null

[11] Patent Number: 5,920,183

[45] Date of Patent: Jul. 6, 1999

[54] VOLTAGE REGULATOR FOR REGULATING ITS OUTPUT VOLTAGE SELECTIVELY WITH RESPECT TO MORE THAN ONE VOLTAGE

[75] Inventor: Michael Null, Santa Cruz, Calif.

[73] Assignee: STMicroelectronics, Inc., Carrollton, Tex.

[21] Appl. No.: 08/957,079

[22] Filed: Oct. 24, 1997

[51] Int. Cl.[6] ..... G05F 3/04; G05F 5/00

[52] U.S. Cl. ..... 323/312; 323/303; 323/316

[58] Field of Search ..... 323/303, 312, 323/315, 316; 326/124

[56] References Cited

U.S. PATENT DOCUMENTS

| | | | |
|---|---|---|---|
| 5,294,877 | 3/1994 | Cameron | 318/809 |
| 5,309,078 | 5/1994 | Cameron | 318/811 |
| 5,317,243 | 5/1994 | Cameron | 318/254 |
| 5,450,520 | 9/1995 | Carobolante | 388/815 |
| 5,469,082 | 11/1995 | Bullinger et al. | 326/81 |
| 5,675,241 | 10/1997 | Teggatz et al. | 323/303 X |
| 5,694,031 | 12/1997 | Stanojevic | 323/315 X |

*Primary Examiner*—Peter S. Wong
*Assistant Examiner*—Y. J. Han
*Attorney, Agent, or Firm*—Theodore E. Galanthay; Lisa K. Jorgenson; Robert D. McCutcheon

[57] ABSTRACT

A voltage regulator for producing an output voltage that selectively tracks a logic voltage or a reference voltage and method of operating the voltage regulator. The voltage regulator has a diode OR with a logic and reference transistors. The logic voltage is scaled to be close in value to the reference voltage, if the two are not close in value. When the scaled logic voltage is larger than the reference voltage the logic transistor is on, turning off the reference transistor and passing the logic voltage to the output of the diode OR. When the scaled logic voltage is smaller than the reference voltage the logic transistor is off and the reference transistor is on, passing the reference voltage to the output of the diode OR. The voltage at the output of the diode OR is then compared in a comparator with the voltage at the output of the voltage regulator, which is scaled by the same factor as the logic voltage. The comparator increases the output voltage if it is smaller than the voltage at the output of the diode OR, and decreases the output voltage if it is larger than the voltage at the output of the diode OR. This permits the circuitry attached to the voltage regulator to operate when the logic voltage is not present, and to operate at the exact same voltage as the logic voltage when the logic voltage is present.

25 Claims, 2 Drawing Sheets

VOLTAGE REGULATOR FOR REGULATING ITS OUTPUT VOLTAGE SELECTIVELY WITH RESPECT TO MORE THAN ONE VOLTAGE

BACKGROUND

The present invention relates to improvements in voltage regulators, and is more specifically related to an improved circuit and method for regulating a voltage with respect to more than one voltage.

Most electronic systems are powered of off two voltages. Much of the circuitry in an electronic system, hereinafter first circuitry, operates at a fixed logic voltage. However, typically, some components in the logic of the electronic system, hereinafter second circuitry, need to operate when the logic voltage is not present. The start up circuitry may need to power up to start the electronic system prior to the logic voltage being available, or the shut down circuitry may need to continue to operate after the logic voltage is no longer available. For example, in a disc drive the disc parking circuitry must operate to park the head and shut down the system after the logic voltage is no longer present. Therefore, the second circuitry operates at a voltage, hereinafter input voltage, that is present in the electronic system when the logic voltage is not present and the second circuitry needs to be on. Some examples of the input voltage may be the wire voltage in an automobile or disc drive, or the back emf in a disc drive.

The input voltage may vary over time, therefore the second circuitry is operated of off the input voltage through a voltage regulator that is used to ensure that the voltage that is supplied to the second circuitry remains at a certain predetermined voltage close to the logic voltage. In current technology that predetermined voltage is typically about 5 V. However, as it becomes more common for logic circuitry to operate at lower voltages, the predetermined voltage will be adjusted lower. Ensuring that the voltage supplied to the second circuitry remains at a predetermined voltage is accomplished by comparing the voltage at the output of the voltage regulator, hereinafter output voltage, with a fixed voltage within the electronic system that is always present, such as the bandgap voltage in a disc drive.

Therefore, the voltage supplied to the second circuitry, i.e., the output voltage, tracks the fixed voltage always present in the electronic system. This ensures that the output voltage remains constant. During normal operation of the electronic system, when both the first and second circuitry are operating and both voltages are present, the first and second circuitry need to interface and work together. To work together the voltages at which the first and second circuitry operate should be equal or as close to equal as possible.

Unfortunately, neither the input voltage nor the fixed voltage is usually equal to the logic voltage, producing an output voltage that is not equal to the logic voltage. For the first and second circuitry to be able to work together correctly requires that the output voltage be adjusted to be more comparable to the logic voltage. A level shifter is usually added at each location where voltage is supplied to the second circuitry, between the voltage regulator and the input of the second circuitry where the voltage is supplied. This may require as many as thirty level shifters to be added to a typical disc drive.

Each level shifter requires several transistors. Having to add a plurality of level shifters requires a great deal of additional space, increasing both the cost and size of the circuit containing the second circuitry, going against the long standing goals of the semiconductor industry to reduce the size and cost of circuits. However, eliminating the level shifters makes the voltage supplied to the second circuitry somewhat different than the logic voltage, which is supplied to the first circuitry. This will not permit the first and second circuitry to operate well together, reducing the performance of the electronic system.

SUMMARY OF THE INVENTION

A voltage regulator for regulating an input voltage to produce an output voltage that tracks a logic voltage responsive to the logic voltage being larger than a predetermined voltage and tracks a reference voltage responsive to the logic voltage being smaller than the predetermined voltage. The voltage regulator includes a diode OR circuit and a comparator. The diode OR circuit has a logic input for receiving the logic voltage, a reference input for receiving the reference voltage, and a diode OR output. The comparator has a first input coupled to the diode OR output, a feedback input, and a comparator output for receiving the output voltage, the comparator output is coupled to the feedback input, for comparing the output voltage with the voltage on the first input.

In accordance with the method of operation of the circuit of the present invention, the diode OR determines whether the logic voltage is larger than a predetermined voltage. When the logic voltage is larger than the predetermined voltage, tracking the logic voltage with the output voltage. When the logic voltage is smaller than the predetermined voltage, tracking the reference voltage with the output voltage.

The novel features believed characteristic of the invention are set forth in the appended claims. The nature of the invention, however, as well as its features and advantages, may be understood more fully upon consideration of illustrative embodiments when read in conjunction with the accompanying drawings, wherein:

DETAILED DESCRIPTION OF THE PREFERRED EMBODIMENT

Figure 1:
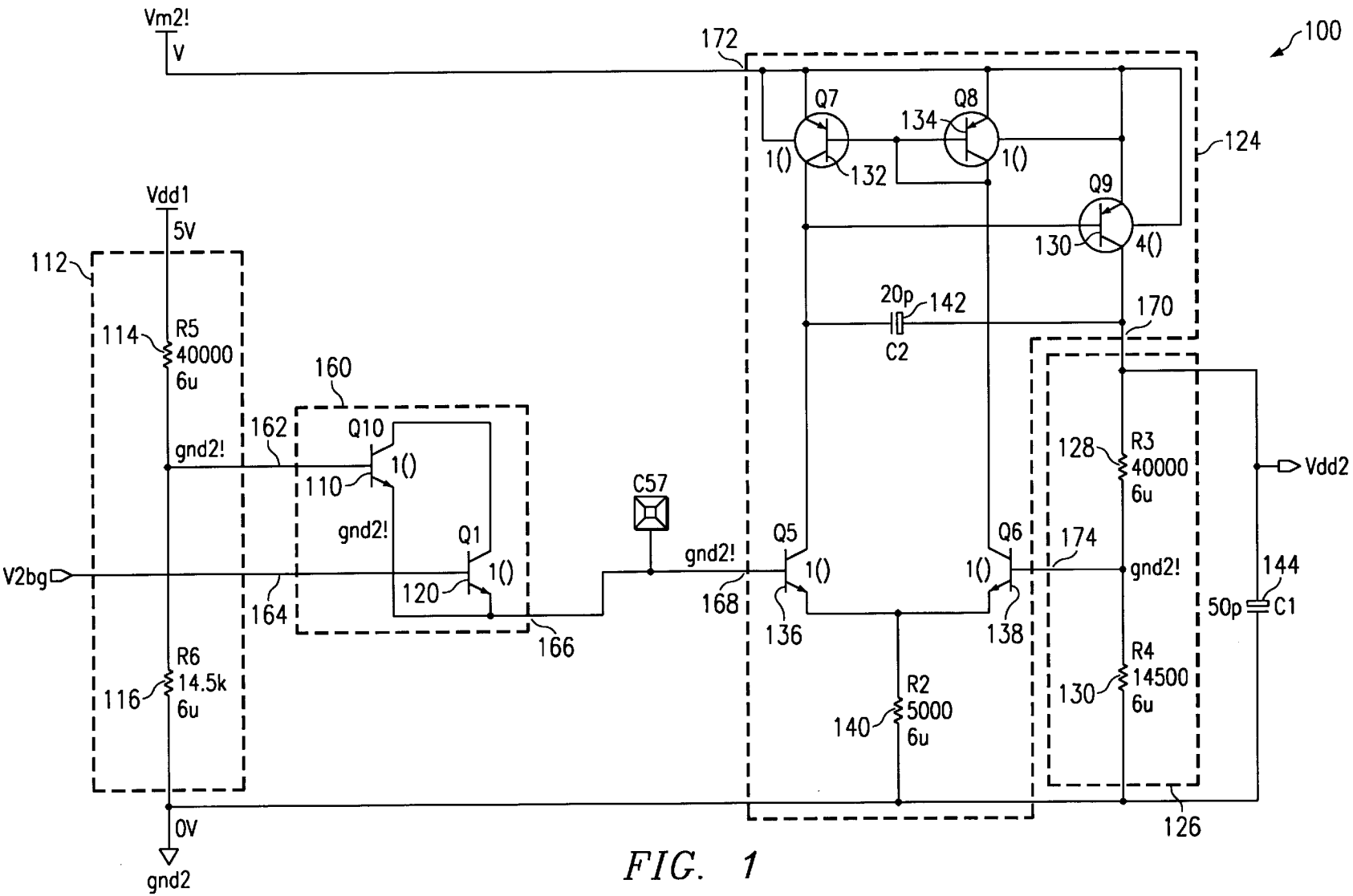
FIG. 1 is a circuit diagram of a logic regulator having a diode OR and a comparator according to an embodiment of the present invention.

Referring to FIG. 1, a voltage regulator according to an embodiment of the invention is designated generally by reference numeral 100. The voltage regulator 100 is typically included in a motor driver circuit of a polyphase dc motor, the operational circuitry of a computer, the electronics system of an automobile, a consumer electronic system such as a stereo system, or in any circuit that has first circuitry and second circuitry, the first circuitry being operated at a logic voltage Vdd1, typically generated from an external logic voltage supply. The second circuitry interfaces with the first circuitry when the first circuitry is operating and also needs to be operational when the logic voltage supply is not available. Preferably the entire voltage regulator is integrated into a single IC.

The voltage regulator 100 is powered by the input voltage Vm2. The input voltage Vm2 has to be available when the second circuitry needs to be operational. The input voltage Vm2 can be the wire voltage in most electronic systems, or the back emf voltage in a disc drive. The voltage regulator 100 regulates the input voltage Vm2 to produce an output voltage Vdd2. The output voltage Vdd2 should track the logic voltage Vdd1, which is typically about 5 V, when the logic voltage Vdd1 is available. However, the output voltage Vdd2 needs to still be at about the same voltage even when logic voltage Vdd1 is not available, since the second circuitry needs to be operational when the rest of the circuitry is off. Some examples of the second circuitry are the parking or shut down circuitry in a motor for a disc drive, or the shut down circuitry in an electronic system of an automobile.

The voltage regulator 100 has diode OR circuit 160 that has a logic input 162 on which the logic voltage Vdd1 is received, and a reference input 164 on which a reference voltage V2bg is received. The diode OR circuit 160 includes a logic voltage switch 110 and a reference voltage switch 120. The logic voltage switch 110 and the reference voltage switch 120 are both typically transistors, hereinafter logic transistor 110, and reference transistor 120, respectively. The base of transistor 110, i.e., the input of the logic voltage switch, is the logic input of the diode OR 160. The emitter of logic transistor 110 is connected to the emitter of the reference transistor 120; the emitters form the diode OR output 166. The collector of logic transistor 110 is connected to the collector of reference transistor 120. The base of reference transistor 120, i.e., the input of the reference voltage switch, is the reference input of the diode OR 160.

The reference voltage V2bg can be any fixed voltage. In a driver circuit for a motor in a disc drive, the reference voltage can be the bandgap voltage. The bandgap voltage is typically about 1.2 V. In a case such as this, when the reference voltage V2bg is not close in value to the logic voltage Vdd1 one of them is scaled to be able to compare them in the diode OR circuit 160. Typically, the logic voltage Vdd1 is scaled in a logic voltage divider 112. The input of the logic voltage divider 112 receives the logic voltage Vdd1. The output of the logic voltage divider is connected to the base of the logic transistor 110. The resistors 114, 116 in the logic voltage divider are chosen such that they will divide the logic voltage Vdd1 to make it close in value to the reference voltage V2bg. For the logic voltage Vdd1 of 5V and reference voltage of 1.2 V, resistor 114 can be 40 $k_{\Omega}$ and resistor 116 can be 14.5 $k_{\Omega}$.

The diode OR 160 selectively passes the scaled logic voltage Vdd1 and the reference voltage V2bg to the output of the diode OR 166. The output of the diode OR 166 is coupled to the first input 168 of a comparator 124. The comparator 124 also has a second input 172 for receiving the input voltage Vm2, a comparator output 170 for receiving the output voltage Vdd2 from the comparator 124, and a feedback input 174. The comparator output 170 is coupled to the second circuitry. Preferably, a filter capacitor 144 is coupled between the comparator output 170 and ground to filter the output voltage Vdd2. The comparator output 170 is also coupled to the feedback input 174 for the output voltage Vdd2 to be fed back into the comparator 124 to be compared with the scaled logic voltage Vdd1 or the reference voltage V2bg at the first input 168 of the comparator 124.

When the reference voltage V2bg is not close in value to the logic voltage Vdd1, the output voltage Vdd2 is scaled to be able to compare the output voltage Vdd2 to the reference voltage V2bg and to the scaled logic voltage Vdd1. The output voltage Vdd2 is scaled in an output voltage divider 126. The input of the output voltage divider 126 receives the output voltage Vdd2. The output of the output voltage divider 126 is connected to the feedback input 174 of the comparator 124. The resistors 128, 130 in the output voltage divider 126 are chosen such that they will divide the output voltage Vdd2 to make it close in value to the reference voltage V2bg. Preferably, the output voltage divider 126 is equivalent to the logic voltage divider 112 and the value of the resistors 128, 130 in the output voltage divider 126 is equal to the value of the resistors 114, 116, respectively, in the logic voltage divider 112.

The comparator 124 includes a differential stage, having transistors 136 and 138. A resistor 140 is coupled between the differential stage and ground. The base of transistor 136 is the first input 168 of the comparator 124 and the base of transistor 138 is the feedback input 174 of the comparator 124. The differential stage 136, 138 is coupled to a current mirror, having transistors 132 and 134, that forms the second input of the comparator 124. The comparator 124 also includes a comparing transistor 130 and a capacitor 142, the base of the comparing transistor 130 and one end of the capacitor 142 are coupled between the differential stage 136, 138 and the current mirror 132, 134. The emitter of the comparing transistor 130 and the other end of the capacitor 142 are coupled to the comparator output 170. The collector of the comparing transistor 130 is coupled to the input voltage Vin2. Although, a particular comparator is described, any conventional comparator can be used as long as the comparator can regulate an input voltage Vm2 based on the comparison of the voltage on the output of the comparator and one of its inputs. Typically, a conventional voltage regulator will already contain such a comparator used to compare the reference voltage and the output voltage; therefore, no additional circuitry is required for the comparator.

Figure 2:
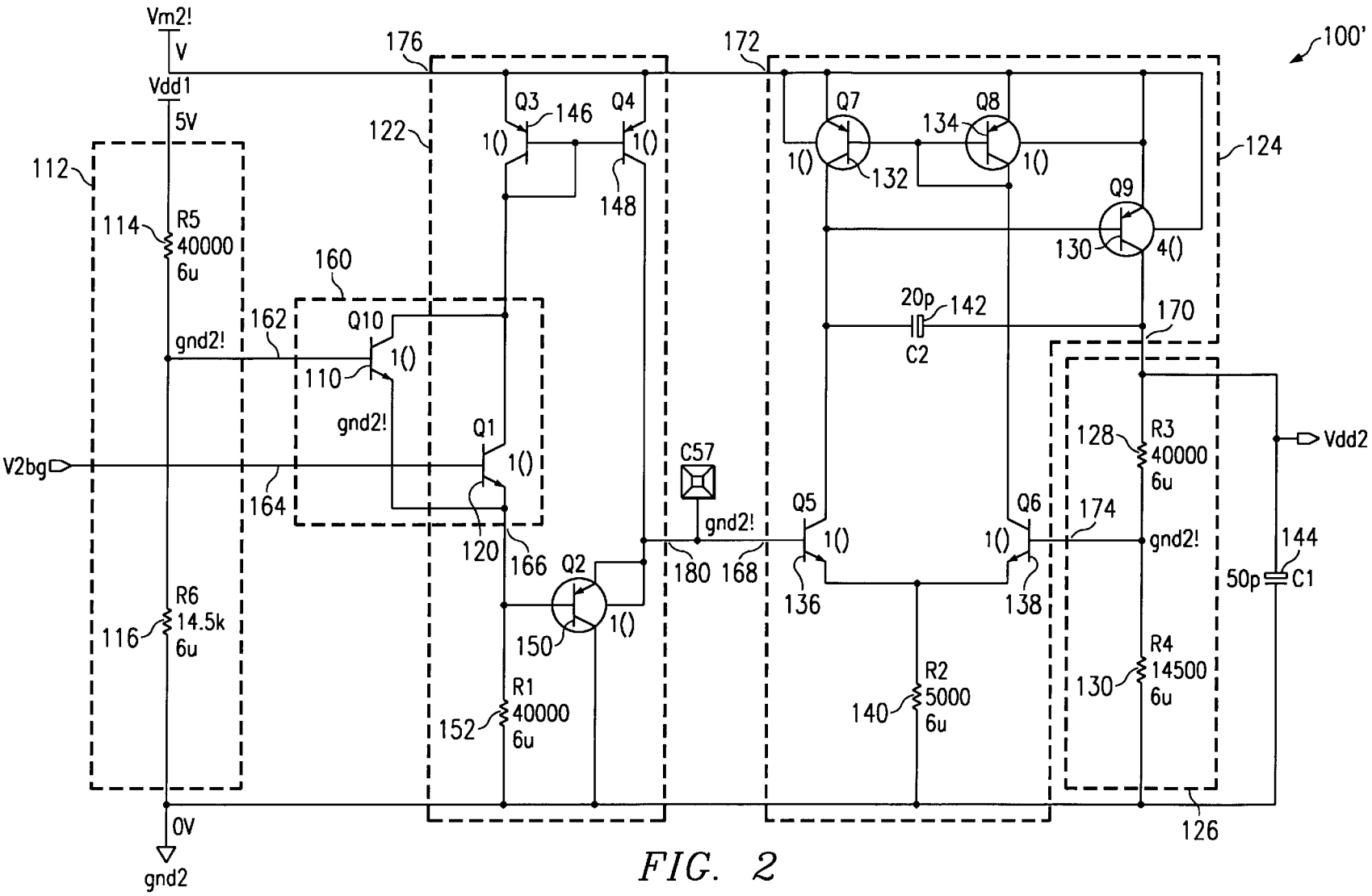
FIG. 2 is a circuit diagram of a logic regulator having a diode OR, a comparator, and a buffer according to the embodiment of the present invention.

Optionally, as shown in FIG. 2, a buffer 122 can be added to the voltage regulator 100' to buffer the voltage at the first input 168 of the comparator 124 to avoid the possibility of saturating transistor 136. The buffer 122 contains the reference transistor 120, thus when the buffer 122 is added, a part of the diode OR will be in the buffer 122. The emitter of the reference transistor 120 is connected to the input of a current mirror formed from transistors 146 and 148. A resistor 152 is connected between the collector of reference transistor 120 and ground. The collector of the reference transistor 120 is also connected to the base of transistor 150. The collector of transistor 150 and the output of the current mirror 146, 148 are connected to each other and to a buffer output 180. The buffer output 180 is connected to the first input 168 of the comparator 124. The buffer 122 operates of off the input voltage Vm2, which is supplied to the current mirror 146, 148. Like the comparator 124, the buffer 122 can be any conventional buffer that has a transistor that receives a reference voltage V2bg. Typically, a conventional voltage regulator may already contain such a buffer and no additional circuitry is required.

Referring again to FIG. 1, in operation the diode OR 160 determines whether the logic voltage Vdd1 is larger than the predetermined voltage. When the logic voltage Vdd1 is larger than the predetermined voltage the voltage regulator 100 tracks the logic voltage Vdd1 with the output voltage Vdd2. When logic voltage Vdd1 is smaller than the predetermined voltage the voltage regulator 100 tracks the reference voltage V2bg with the output voltage Vdd2. In current technology, both the logic voltage Vdd1 and the predetermined voltage are close to 5 V, in this example the predetermined voltage is 4.8 V and the logic voltage is about 5V, however as it becomes more common for circuitry to operate at lower voltages, the logic voltage will reflect this and the predetermined voltage should be adjusted lower.

If the logic voltage Vdd1 is close in value to the reference voltage V2bg, typically within a few tenth of a volt, the reference voltage V2bg is the predetermined voltage. Otherwise, the logic voltage Vdd1 is divided in the logic voltage divider 112 to be close in value to the reference voltage V2bg, and the predetermined voltage is the product of the reference voltage V2bg with the value by which the logic voltage is divided. In this example, the reference voltage V2bg is the bandgap voltage of 1.2 V, so the logic voltage Vdd1 should be divided to be able to easily compare it to the bandgap voltage. This scaled logic voltage Vdd1/N is now on the base of the logic transistor 110, and the reference voltage V2bg is on the base of the reference transistor 120.

During normal operation of the electronic system, the logic voltage Vdd1 is larger than the predetermined voltage, the logic transistor 110 will turn on and turn the reference transistor 120 off, passing the scaled logic voltage Vdd1/N to the diode OR output 166, which is connect to the first input of the comparator 124. The scaled logic voltage Vdd1/N is compared to the voltage on the feedback input of the comparator 124, which is the scaled output voltage Vdd2/N. The scaled output voltage Vdd2 is the output voltage Vdd2 divided in the output voltage divider 126 to be close in value to the reference voltage V2bg. If the two voltages Vdd1/N and Vdd2N are not equal the differential stage 136, 138 and the current mirror 132, 134 will drive the base of the comparing transistor 130 to adjust the input voltage Vm2 on the collector of the comparing transistor 130 to produce an adjusted output voltage Vdd2.

When the logic voltage Vdd1 drops below the predetermined voltage, the logic transistor 110 will turn off. The reference transistor 120 will turn on, passing the reference voltage V2bg to the diode OR output 166, which is connected to the first input of the comparator 124. The reference voltage V2bg is compared to the scaled output voltage Vdd2/N that is on the feedback input of the comparator. If the two voltages V2bg and Vdd2/N are not equal, the differential stage 136, 138 and the current mirror 132, 134 will drive the base of the comparing transistor 130 to adjust the input voltage Vm2 on the collector of the comparing transistor to produce an adjusted output voltage Vdd2. At this point the output voltage Vdd2 does not have the exact same value the logic voltage Vdd1 was when it was present. However, since the first circuitry in not operating when the logic voltage Vdd1 is not present, the second circuitry does not need to interface with the first circuitry and the small difference in the voltage does not have any effect.

A diode OR allows the voltage regulator to regulate the input voltage V2m to produce an output voltage Vdd2 that tracks a logic voltage Vdd1 when the logic voltage Vdd1 is present and tracks a reference voltage V2bg when the logic voltage Vdd1 is not present. Tracking the reference voltage V2bg with the output voltage Vdd2 allows the output voltage Vdd2 to be at the needed value to operate the second circuitry when the logic voltage is not present. Tracking the logic voltage Vdd1 with output voltage V2bg allows the output voltage Vdd2 to be equal to the logic voltage Vdd1 when both are present, permitting the first and second circuitry to operate at the same voltage. This allows the first and second circuitry to interface and work correctly together without the need for extensive additional circuitry, eliminating the level shifters used in conventional circuits to perform this function, thus reducing the size and cost of the circuit.

Although the invention has been specifically described with reference to several preferred and alternative embodiments, it will be understood by those skilled in the art having reference to the current specification and drawings that various modifications may be made and further alternatives are possible without departing from the spirit and scope of the invention as set forth in the appended claims.

I claim:

1. A voltage regulator for regulating an input voltage to produce an output voltage that tracks a logic voltage responsive to the logic voltage being larger than a predetermined voltage and tracks a reference voltage responsive to the logic voltage being smaller than the predetermined voltage, the voltage regulator comprising:

a diode OR circuit having a logic input for receiving the logic voltage, a reference input for receiving the reference voltage, and a diode OR output, for passing the logic voltage to the diode OR output responsive to the logic voltage being larger than the predetermined voltage and passing the reference voltage to the diode OR output responsive to the logic voltage being smaller than the predetermined voltage; and a comparator having a first input coupled to the diode OR output, a feedback input, and a comparator output for outputting the output voltage, the comparator output coupled to the feedback input, for comparing the output voltage with a voltage on the first input.

2. The voltage regulator of claim 1, wherein the diode OR comprises:

a reference voltage switch having an input for receiving the reference voltage and an output coupled to the diode OR output, for selectively passing the reference voltage to the diode OR output; and a logic voltage switch having an input for receiving the logic voltage, and an output coupled to the diode OR output, for selectively passing the logic voltage to the diode OR output and for opening the reference voltage switch.

3. The voltage regulator of claim 2, wherein the reference voltage switch comprises a transistor and the logic voltage switch comprises a transistor.

4. The voltage regulator of claim 1, further comprising:

an output voltage divider having an input for receiving the output voltage and an output coupled to the feedback input, for dividing the output voltage to reflect the reference voltage whereby easy comparison of the output voltage and the reference voltage is accomplished; and a logic voltage divider having an input for receiving the logic voltage and an output coupled to the logic voltage switch, for dividing the logic voltage to reflect the reference voltage whereby easy comparison of the logic voltage and the reference voltage is accomplished.

5. The voltage regulator of claim 1, further comprising a buffer having an input coupled to the diode OR output and an output coupled to the first input of the comparator.

6. A voltage regulator for regulating an input voltage to produce an output voltage that tracks a logic voltage responsive to the logic voltage being larger than a predetermined voltage and tracks a reference voltage responsive to the logic voltage being smaller than the predetermined voltage, the voltage regulator comprising:

a buffer having a buffer logic input, a reference input, and output, and a reference voltage switch coupled between the reference input and the output of the buffer, for selectively passing the reference voltage to the output of the buffer;

a logic voltage switch having an input for receiving the logic voltage, and an output coupled to the buffer logic input, for selectively passing the logic voltage to the output of the buffer and for turning off the reference voltage switch; and a comparator having a first input coupled to the output of the buffer, a feedback input, and a comparator output for outputting the output voltage, the comparator output coupled to the feedback input, for comparing the output voltage with a voltage on the first input.

7. The voltage regulator of claim 6, wherein the reference voltage switch comprises a transistor and the logic voltage switch comprises a transistor.

8. The voltage regulator of claim 6, further comprising:

an output voltage divider having an input for receiving the output voltage and an output coupled to the feedback input, for dividing the output voltage to reflect the reference voltage whereby easy comparison of the output voltage and the reference voltage is accomplished; and a logic voltage divider having an input for receiving the logic voltage and an output coupled to the logic voltage switch, for dividing the logic voltage to reflect the reference voltage whereby easy comparison of the logic voltage and the reference voltage is accomplished.

9. A voltage regulator for regulating an input voltage to produce an output voltage that tracks a logic voltage responsive to the logic voltage being larger than a predetermined voltage and tracks a reference voltage responsive to the logic voltage being smaller than the predetermined voltage, the voltage regulator comprising:

a selecting means for selecting the logic voltage responsive to the logic voltage being larger than the predetermined voltage and selecting the reference voltage responsive to the logic voltage being smaller than the predetermined voltage, the selecting means having a logic input for receiving the logic voltage, a reference input for receiving the reference voltage, and an output, wherein the selected voltage is passed to the output of the selecting means; and a regulating means for regulating the output voltage to be approximately equal to the voltage on the output of the selecting means, the regulating means having a first input coupled to the output of the selecting means, a feedback input, and an output for outputting the output voltage, the output coupled to the feedback input.

10. The voltage regulator of claim 9, wherein the selecting means comprises:

a reference voltage switch having an input for receiving the reference voltage and an output coupled to the output of the selecting means, for selectively passing the reference voltage to the output of the selecting means; and a logic voltage switch having an input for receiving the logic voltage, and an output coupled to the output of the selecting means, for selectively passing the logic voltage to the output of the selecting means and for opening the reference voltage switch.

11. The voltage regulator of claim 10, wherein the reference voltage switch comprises a transistor and the logic voltage switch comprises a transistor.

12. The voltage regulator of claim 9, further comprising:

an output voltage divider having an input for receiving the output voltage and an output coupled to the feedback input, for dividing the output voltage to reflect the reference voltage whereby easy comparison of the output voltage and the reference voltage is accomplished; and a logic voltage divider having an input for receiving the logic voltage and an output coupled to the logic input of the selecting means, for dividing the logic voltage to reflect the reference voltage whereby easy comparison of the logic voltage and the reference voltage is accomplished.

13. The voltage regulator of claim 9, wherein the regulating means comprises a comparator.

14. The voltage regulator of claim 9, further comprising a buffer having an input coupled to the output of the selecting means and an output coupled to the first input of the regulating means.

15. An apparatus comprising, first circuitry operating at a logic voltage;

second circuitry operating at an output logic voltage; and a voltage regulator for regulating an input voltage to produce the output voltage that tracks the logic voltage responsive to the logic voltage being larger than a predetermined voltage and tracks a reference voltage responsive to the logic voltage being smaller than the predetermined voltage, the voltage regulator comprising:

a diode OR circuit having a logic input for receiving the logic voltage, a reference input for receiving the reference voltage, and a diode OR output, for passing the logic voltage to the diode OR output responsive to the logic voltage being larger than the predetermined voltage and passing the reference voltage to the diode OR output responsive to the logic voltage being smaller than the predetermined voltage; and a comparator having a first input coupled to the diode OR output, a feedback input, and a comparator output for outputting the output voltage, the comparator output coupled to the feedback input, for comparing the output voltage with a voltage on the first input.

16. The apparatus of claim 15, wherein the diode OR comprises:

a reference voltage switch having an input for receiving the reference voltage and an output coupled to the diode OR output, for selectively passing the reference voltage to the diode OR output; and a logic voltage switch having an input for receiving the logic voltage, and an output coupled to the diode OR output, for selectively passing the logic voltage to the diode OR output and for opening the reference voltage switch.

17. The apparatus of claim 16, wherein the reference voltage switch comprises a transistor and the logic voltage switch comprises a transistor.

18. The apparatus of claim 15, further comprising:

an output voltage divider having an input for receiving the output voltage and an output coupled to the feedback input, for dividing the output voltage to reflect the reference voltage whereby easy comparison of the output voltage and the reference voltage is accomplished; and a logic voltage divider having an input for receiving the logic voltage and an output coupled to the logic voltage switch, for dividing the logic voltage to reflect the reference voltage whereby easy comparison of the logic voltage and the reference voltage is accomplished.

19. The apparatus of claim 15, further comprising a buffer for buffer having an input coupled to the diode OR output and an output coupled to the first input of the comparator.

20. The apparatus of claim 15, wherein the apparatus comprises a disc drive.

21. The apparatus of claim 15, wherein the apparatus comprises an automobile.

22. A method of regulating an input voltage to produce an output voltage in an apparatus capable of receiving a logic voltage and having a reference voltage; comprising the steps of:

determining whether the logic voltage is larger than a predetermined voltage;

tracking the logic voltage with the output voltage responsive to the logic voltage being larger than the predetermined voltage; and tracking the reference voltage with the output voltage responsive to the logic voltage being smaller than the predetermined voltage.

23. The method of claim 22, wherein:

the apparatus further comprises:

a reference voltage switch having an input for receiving the reference voltage and an output;

a logic voltage switch having an input for receiving the logic voltage, and an output;

a comparator having a first input coupled to the outputs of the reference voltage switch and the logic voltage switch, a feedback input, and a comparator output for outputting the output voltage, the comparator output coupled to the feedback input;

the step of tracking the logic voltage with the output voltage comprises the steps of:

closing the logic voltage switch to pass the logic voltage to the first input of the comparator;

opening the reference voltage switch; and comparing the output voltage with the logic voltage on the first input of the comparator; and the step of tracking the reference voltage with the output voltage comprises the steps of:

closing the reference voltage switch to pass the reference voltage to the first input of the comparator;

opening the logic voltage switch; and comparing the output voltage with the reference voltage on the first input of the comparator.

24. The method of claim 23, further comprising the steps of:

responsive to the logic voltage not being about equal to the reference voltage:

dividing the output voltage for making the output voltage about equal to the reference voltage for easy comparison of the output voltage with the reference voltage; and, whereby the step of tracking the logic voltage with the output further comprises the step of dividing the logic voltage for making the logic voltage about equal to the reference voltage for easy comparison of the output voltage with the logic voltage.

25. The method of claim 23, wherein the reference voltage switch comprises a transistor and the logic voltage switch comprises a transistor.

* * * * *